US007941883B2

(12) United States Patent
Moule et al.

(10) Patent No.: US 7,941,883 B2
(45) Date of Patent: May 17, 2011

(54) THERAPEUTIC MATTRESS

(75) Inventors: Terry Glyn Moule, Redbourn (GB); Patricia Ann Moule, legal representative, Redbourn (GB); Neal Marshall, Solihull (GB)

(73) Assignee: Seating Design and Development Limited (GB)

( * ) Notice: Subject to any disclaimer, the term of this patent is extended or adjusted under 35 U.S.C. 154(b) by 180 days.

(21) Appl. No.: 11/922,822

(22) PCT Filed: Jun. 26, 2006

(86) PCT No.: PCT/GB2006/002342

§ 371 (c)(1),
(2), (4) Date: Mar. 26, 2009

(87) PCT Pub. No.: WO2007/000581

PCT Pub. Date: Jan. 4, 2007

(65) Prior Publication Data

US 2010/0218319 A1 Sep. 2, 2010

(30) Foreign Application Priority Data

Jun. 29, 2005 (GB) ..... 0513286.5

(51) Int. Cl.
*A47C 27/14* (2006.01)

(52) U.S. Cl. ..... 5/727; 5/740

(58) Field of Classification Search ..... 5/727, 730–735, 5/740

See application file for complete search history.

(56) References Cited

U.S. PATENT DOCUMENTS

| | | | | |
|---|---|---|---|---|
| 1,548,728 | A * | 8/1925 | Milam | 5/722 |
| 3,731,327 | A * | 5/1973 | Frey | 5/690 |
| 3,828,378 | A * | 8/1974 | Flam | 5/730 |
| 4,042,987 | A * | 8/1977 | Rogers | 5/730 |
| 4,245,361 | A | 1/1981 | Evanson et al. | |
| 4,335,476 | A | 6/1982 | Watkin et al. | |
| 4,975,996 | A | 12/1990 | Evans et al. | |
| 5,038,433 | A * | 8/1991 | Farley | 5/730 |
| 5,195,196 | A | 3/1993 | Johenning et al. | |
| 5,566,413 | A * | 10/1996 | Webb et al. | 5/655 |
| 5,974,608 | A * | 11/1999 | Haller et al. | 5/709 |
| 6,085,373 | A * | 7/2000 | Montana | 5/727 |
| 7,647,660 | B2 * | 1/2010 | Tullous | 5/655 |

FOREIGN PATENT DOCUMENTS

| | | |
|---|---|---|
| DE | 10055352 A1 | 5/2001 |
| DE | 10301557 A1 | 7/2004 |
| GB | 2313777 A | 12/1997 |
| WO | WO 99/58027 | 11/1999 |

* cited by examiner

*Primary Examiner* — Michael Trettel
(74) *Attorney, Agent, or Firm* — Iandiorio Teska & Coleman

(57) ABSTRACT

A mattress (2) which in plan view comprises an inner portion (4) and an outer portion (6), and the mattress (2) being such that the inner portion (4) is of a size for being slept on by at least one person, the outer portion (6) extends at least partially around the inner portion (4), and the inner portion (4) has a lower compression rate than the outer portion (6) whereby the weight of the person on the inner portion (4) is distributed over a greater area than would be the case if the inner portion (4) had the same compression rate as the outer portion (6), and whereby the outer portion (6) constrains the inner portion (4) and controls lateral expansion of the inner portion caused by the weight of the person on the inner portion (4).

8 Claims, 6 Drawing Sheets

THERAPEUTIC MATTRESS

This invention relates to a mattress.

It is well known that mattresses are manufactured with varying degrees of hardness. Generally, the mattresses are mainly manufactured to be soft, medium or hard. Typically, persons with back problems prefer hard mattresses.

Accordingly, the present invention provides a mattress which in plan view comprises an inner portion and an outer portion, and the mattress being such that the inner portion is of a size for being slept on by at least one person, the outer portion extends at least partially around the inner portion, the inner portion is made of a foam material, the outer portion is made of a foam material, the inner portion has a plurality of apertures, the apertures are of a constant diameter, the apertures are spaced apart by a constant distance, and the apertures cause the inner portion to have a lower compression rate than the outer portion whereby the weight of the person on the inner portion is distributed over a greater area than would be the case if the inner portion had the same compression rate as the outer portion, and whereby the outer portion constrains the inner portion and controls lateral deformation of the inner portion caused by the weight of the person on the inner portion.

The mattress of the present invention may still be manufactured to be soft, medium or hard. However, in addition, with the mattress of the present invention, and within the chosen range of hard, medium or soft, the mattress has the facility of being able to distribute the weight of the person on the inner portion over a greater area than would be the case if the inner portion had the same compression rate as the outer portion. Advantageously, this extra facility has the effect of decreasing pressure on body areas where undue pressure can interfere with the normal flow of blood, nerve signals and responses. As well as aiding the functions of the nervous system of a person, the mattress of the present invention by virtue of the inner portion is able to reduce pressure on the person's vascular system, and in particular is able to aid the venous return. This is in contrast to normal beds which do not reduce pressure on the vascular system and therefore which do not aid the venous return. With the mattress of the present invention, the effects of increased nerve supply and decreased pressure on the venous return enable the person to lie more comfortably, to have a drastically reduced possibility of pressure induced circulatory and nerve supply problems, and also to have a better sleep on the mattress than would otherwise be the case. The mattress of the present invention not only allows for correct postural sculpting of the person's body whilst lying on the mattress, but the mattress also enhances the operation of the person's bodily system so that it is able to operate with minimal restriction by lowering the pressure. Thus the mattress gives both comfort and increased health while in normal sleeping positions.

The mattress may be one in which the inner portion is in the shape of a sleeping person.

The shape may be the shape of a sleeping person in one sleeping position. Thus the shape may be the shape of a person lying on their back or their front.

Alternatively, the shape may be the shape of a sleeping person in more than one sleeping position. Thus, for example, this shape may be designed to cater for person sleeping on their back or their front and also curled up on one side.

The mattress may be one in which the outer portion extends all around the inner portion except for a foot part of the inner portion. Alternatively, the outer portion may extend completely around the inner portion. Alternatively, the outer portion may extend completely around the inner portion except for designated a part or parts which may or may not include the foot part.

In all embodiments of the invention, the mattress may include a top covering layer, the top covering layer being such that it extends over the inner and outer portions. The effect of the top covering later may be to even out differences to the person's body at transition points between the inner and outer portions. The top covering layer may be made of a foam material. Other materials may be employed, for example gels as mentioned above.

The mattress may be a single mattress in which case the inner portion will usually be for one person. Alternatively, the mattress may be a double mattress. With a double mattress, the inner portion will usually be for two persons. When there is an inner portion for two persons, then the inner portion may be formed by one area which for the two persons, or the inner portion may be formed by two areas which are one of each person. When the inner portion has the two areas, then the two areas may be separated by a part which is formed by a reduced thickness of the inner portion and/or by a part which has a higher compression rate than the compression rate of the two areas.

In all embodiments of the present invention, the mattress will usually be one in which the inner portion is all in one piece. If desired however the inner portion may be in a plurality of pieces.

Embodiments of the invention will now be described solely by way of example and with reference to the accompanying drawings in which.

Figure 1:
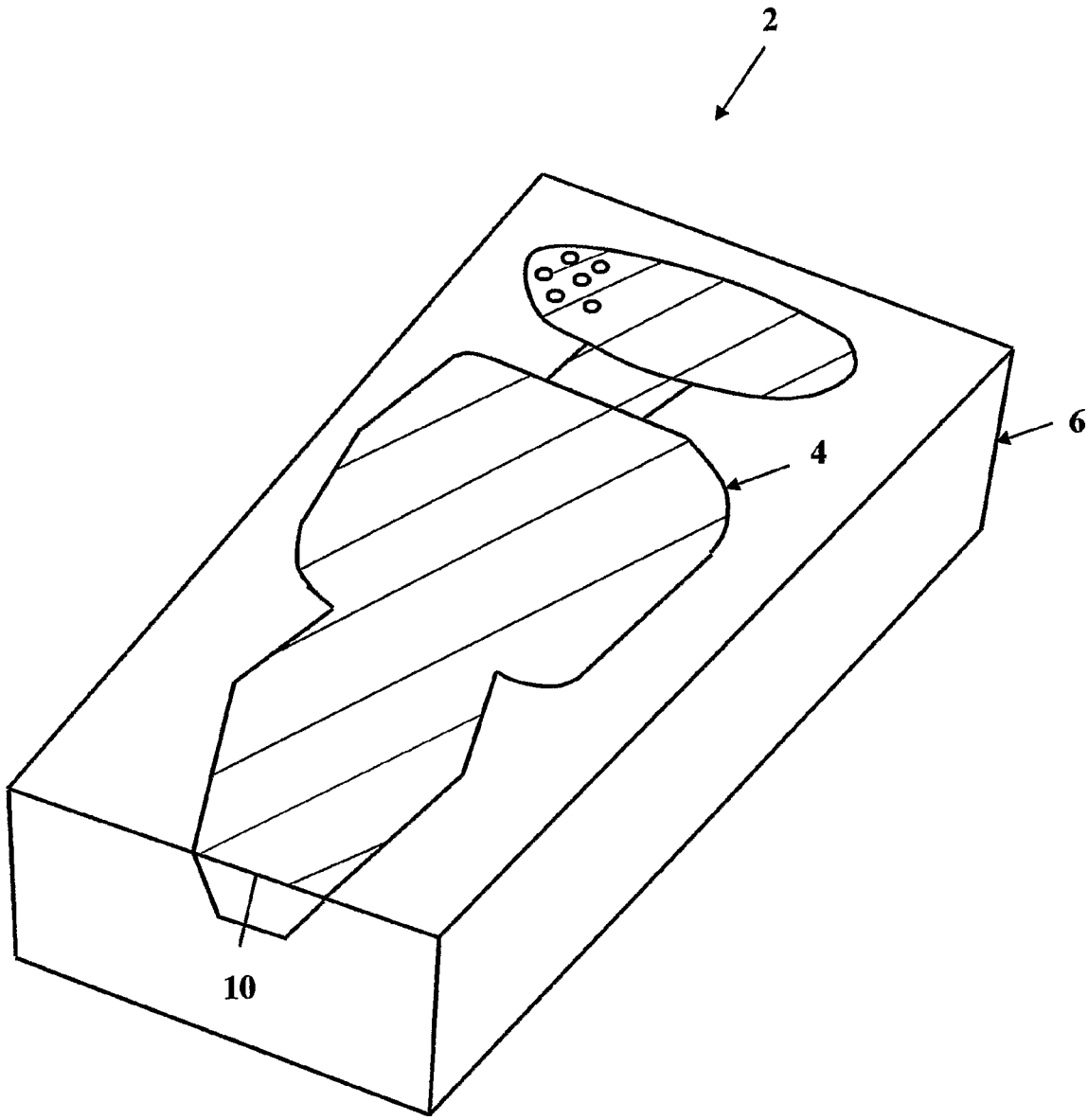
FIG. 1 is a perspective view of a first mattress of the invention.

Referring to FIG. 1, there is shown a mattress 2 which in plan view comprises an inner portion 4 and an outer portion 6. The mattress 2 is such that the inner portion 4 is of a size for being slept on by a person. The outer portion 6 extends partially around the inner portion 4. The mattress 2 is such that the inner portion 4 has a lower compression rate than the outer portion 6, whereby the weight of the person on the inner portion 4 is distributed over a greater area than would be the case if the inner portion 4 had the same compression rate as the outer portion 6, and whereby the outer portion 6 constrains the inner portion 4 and controls lateral deformation of the inner portion 4 caused by the weight of the person on the inner portion 4.

As can be seen from FIG. 1, the inner portion 4 is in the shape of a person sleeping on their back. More specifically, the shape is the shape of the person sleeping in one sleeping position, that is on their back or their front. In an alternative embodiment of the invention (not shown) the shape of the sleeping person could be of the person sleeping in more than one position, for example on their back or their front and also curled up on one side. Such a shape would be bigger than the shape shown in FIG. 1 and the shape would take into account that the person might wish to sleep on their left side or their right side.

As can also be seen from FIG. 1, the outer portion 6 extends all around the inner portion 4 except for a foot part 10 of the inner portion 4.

Figure 2:
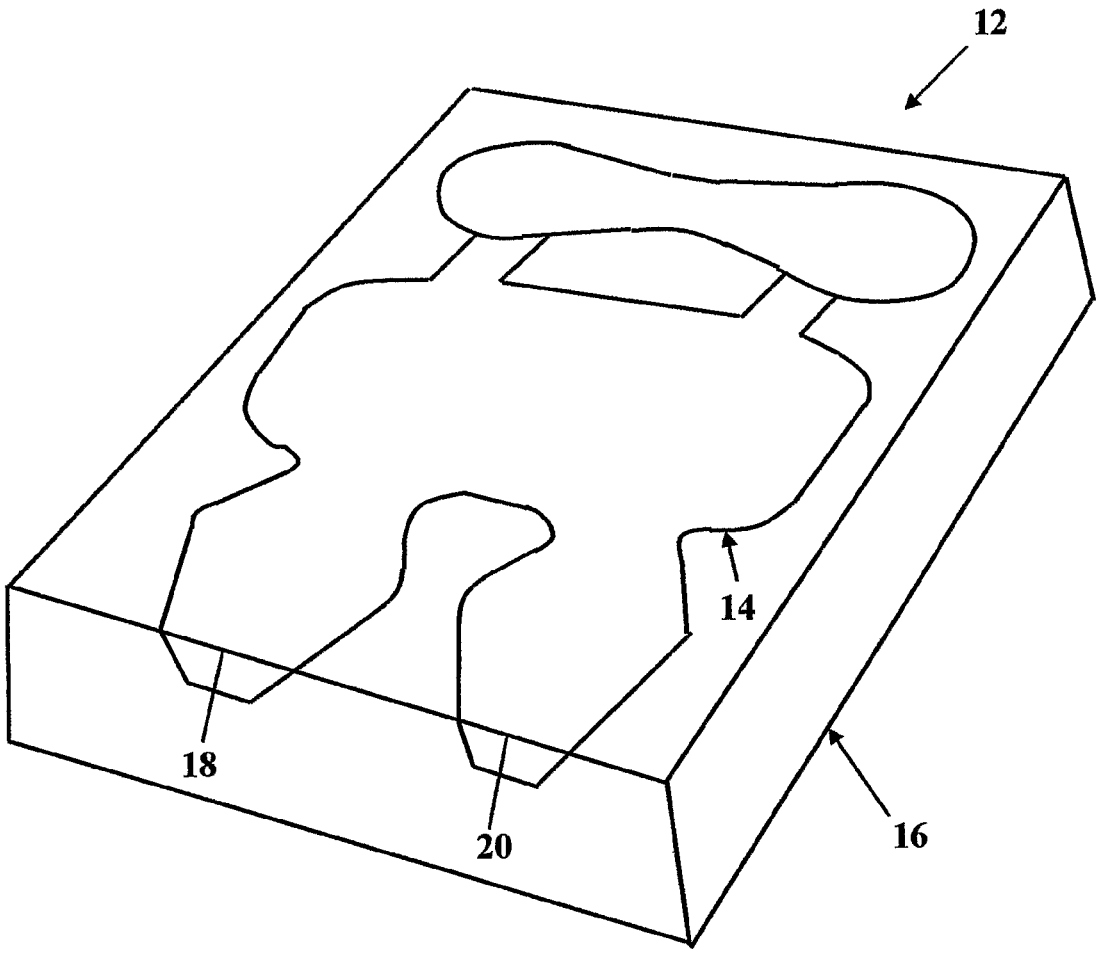
FIG. 2 is a perspective view of a second mattress of the invention.

The mattress 2 is a single mattress with the inner and outer portions defining the shape for one person. FIG. 2 shows a mattress 12 having an inner portion 14 and an outer portion 16. The mattress 12 is a double mattress and the inner portion 14 is in a shape for occupation by two persons rather than a single person. It will be noted that the outer portion 16 extends around the inner portion 4 except for two feet parts 18, 20.

Figure 3:
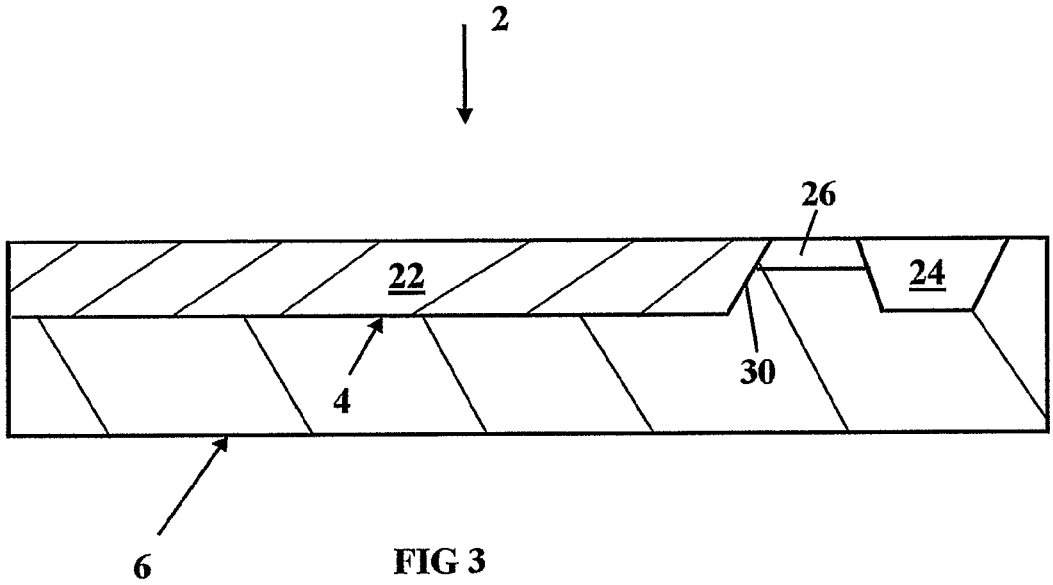
FIG. 3 is a longitudinal section through a third mattress of the invention.

FIG. 3 is a longitudinal section through the mattress 2 but it may equally well be a longitudinal section through the mattress 4. As shown in FIG. 3, the inner portion 4 is all in one piece and it comprises a body part 22 and a head part 24. The body part 22 and the head part 24 are separated by a neck part 26. The neck part 26 is shallower in depth than the depth of the body part 22 and the head part 24.

Figure 4:
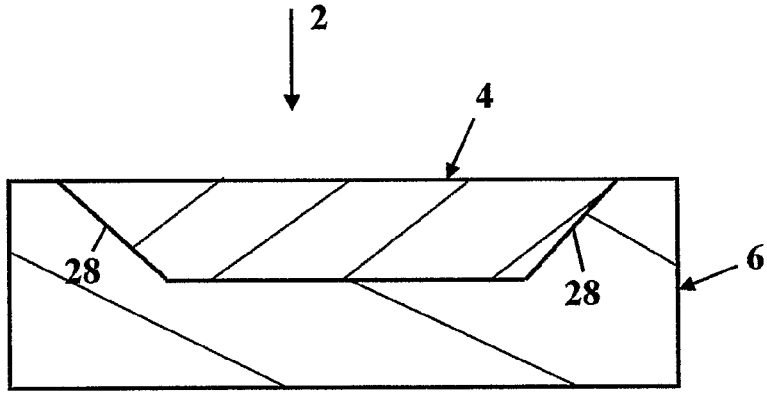
FIG. 4 is a cross-section through a body part of the mattress shown in FIG. 3.

FIG. 4 is a cross section through the mattress 2 but it could equally well be a cross section through the mattress 12. As can be seen from FIG. 4, the inner portion 4 is in the form of an insert in the outer portion 6. FIGS. 3 and 4 illustrate how the inner portion 4 has sloping sides 28 and a sloping end 30.

Figure 5:
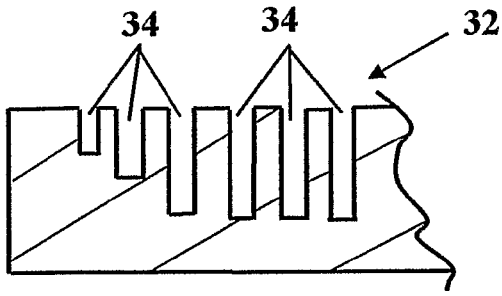
FIG. 5 is a section through part of another mattress of the invention.
Figure 6:
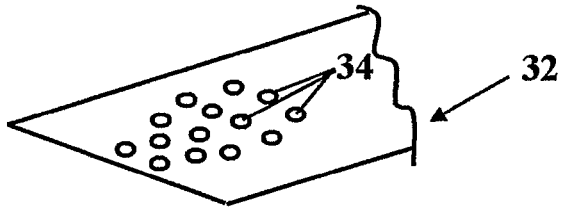
FIG. 6 is a top view of the part of the mattress shown in FIG. 5.

FIGS. 5 and 6 shows how the mattress 32 may be provided with a plurality of apertures in the form of blind bores 34. The bores 34 vary in depth as shown. The bores 34 may be wholly in the inner portion of the mattress 32 or they may be in both the inner portion and the outer portion of the mattress 32. In this latter case, the bores will generally be deeper in the inner portion of the mattress in order to cause the inner portion of the mattress to have the lower compression rate than the outer portion. In an alternative embodiment of the invention (not shown) blind bores of the same depth may be employed, but with the bores only being in the inner portion, or alternatively with the bores being in the inner portion and the outer portion but then with there being more bores in the inner portion than the outer portion in order to cause the inner portion to have the lower compression rate than the outer portion.

Figure 7:
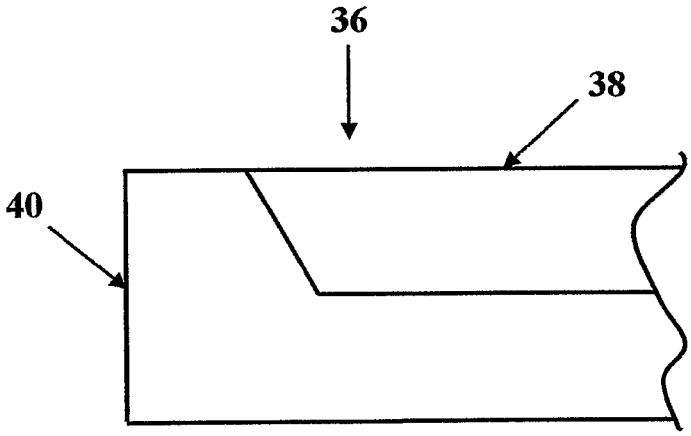
FIG. 7 is a section through part of another mattress of the invention.

FIG. 7 shows a mattress 36 which is not according to the present invention and which has an inner portion 38 and an outer portion 40. The inner portion 38 has the lower compression rate by being such that it is in the form of a container containing a fluid. The fluid may be a gas, a liquid, or a mixture of a liquid and a gas.

Figure 8:
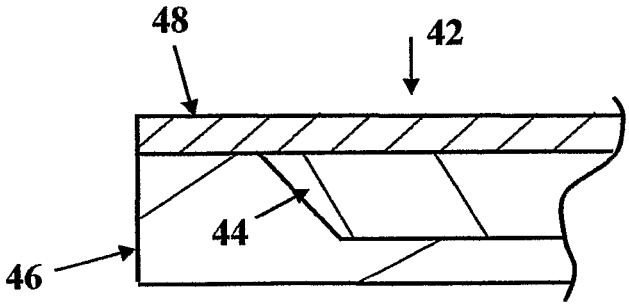
FIG. 8 is a section through part of another mattress of the invention.

FIG. 8 shows a mattress 42 having an inner portion 44 which has a lower compression rate than an outer portion 46. The mattress includes a top covering layer 48. The top covering layer 48 extends as shown over the inner and outer portions 44, 46. The top covering layer 48 acts to even out pressure transition points between the inner and outer portions 44, 46 and that might otherwise be too noticeable for a person lying on the mattress 42. The top covering layer 48 may be made of a foam material or any other suitable and appropriate material.

Figure 9:
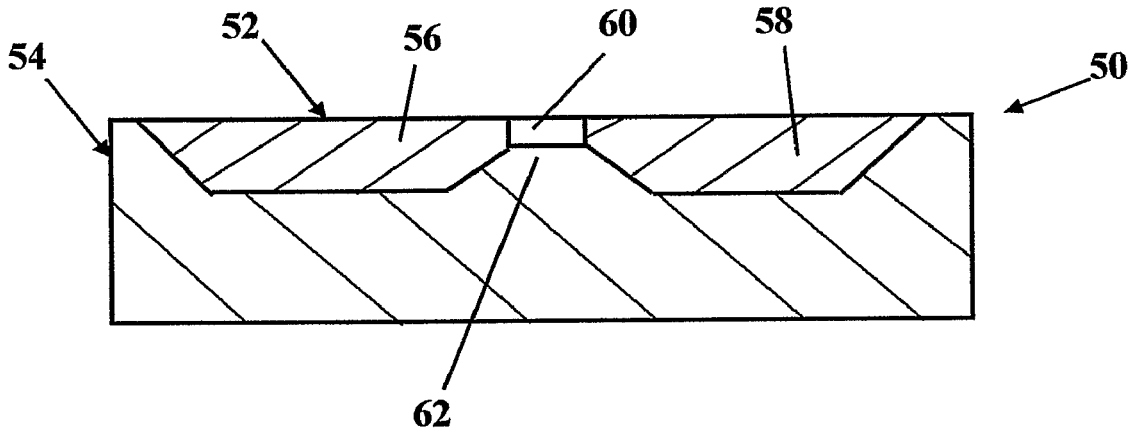
FIG. 9 is a section through another mattress of the invention.

FIG. 9 is a section through a double mattress 50. The mattress 50 has an inner portion 52 and an outer portion 54. The inner portion 52 has two areas 56, 58 which are one for each of two persons that would normally use the double mattress 50. The two areas 56, 58 are separated by a part 60 which is formed by a reduced thickness of the inner portion 52. The outer portion 54 has a central part 62 which is of increased thickness, which helps to separate the two areas 56, 58, and which has a higher compression rate than the compression rate of the two areas 56, 58.

Figure 10:
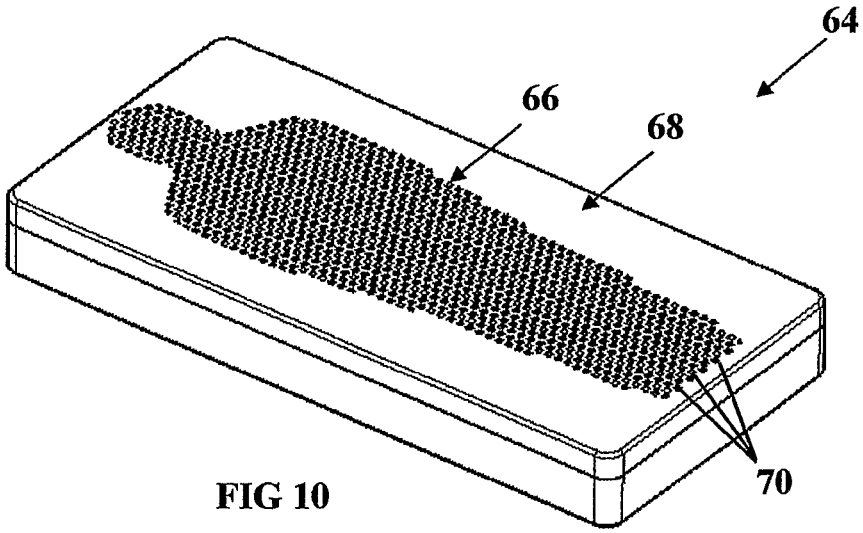
FIG. 10 is a perspective view of another mattress of the invention.

FIG. 10 is a perspective view of a single mattress 64 having an inner portion 66 and an outer portion 68. The outer portion 68 extends as shown around the inner portion 66. The inner portion 66 has a lower compression rate than the outer portion 68. The lower compression rate for the inner portion 66 is achieved by forming the inner portion 66 with a plurality of apertures 70 as shown.

Figure 11:
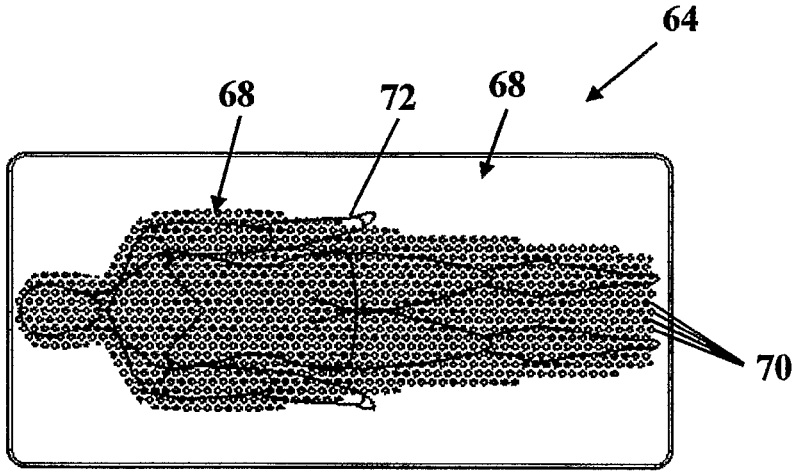
FIG. 11 is a top view of the mattress shown in FIG. 10 and with a person shown lying on the mattress.

FIG. 11 shows a person 72 lying on the mattress 64. It will be seen that the person 72 is able to lie on their front or their back and be within the area provided by the inner portion 66.

Figure 12:
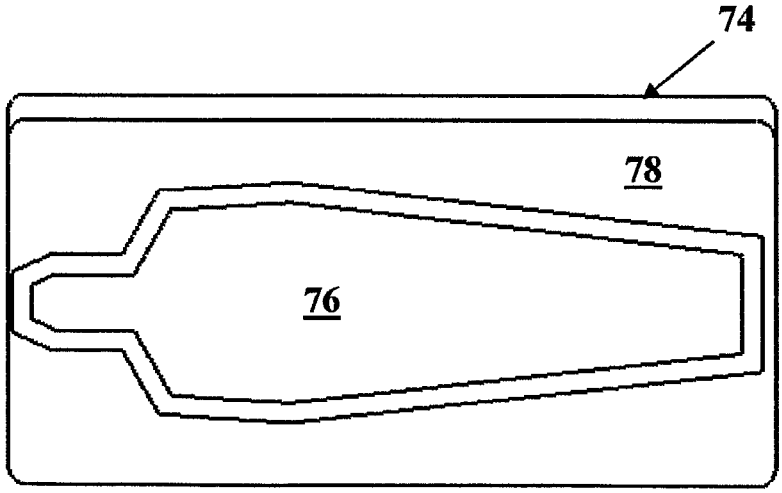
FIG. 12 is a top view of another mattress of the invention.

FIG. 12 shows a mattress 74 having an inner portion 76 and an outer portion 78. The inner portion 76 is of a lower compression rate than the outer portion 78. The difference in the compression rates between the inner and outer portions 76, 78 may be achieved in any of the above mentioned ways. It will be seen that the shape of the inner portion 76 in the mattress 76 is different to the shape of the inner portion 66 in the mattress 64.

Generally, the mattresses according to the present invention and shown in the drawings are such that the inner portion is made of a foam material, the outer portion is made of a foam material, the inner portion has a plurality of apertures, the apertures are of a constant diameter, the apertures are spaced apart by a constant distance, and the apertures cause the inner portion to have the lower compression rate than the outer portion.

It is to be appreciated that the embodiments of the invention described above with reference to the accompanying drawings have been given by way of example only and that modifications may be effected. Thus, for example, the illustrated shapes of the inner portions may vary and they may be of simple rectangular shapes. The mattresses may include a top covering layer and the top covering layer may be such that it extends over the inner and outer portions. The top covering layer may be made of any suitable and appropriate material. The entire mattress may be covered with an appropriate fabric material as may be desired.

The invention claimed is:

1. A mattress which in plan view comprises an inner portion and an outer portion, and the mattress being such that the inner portion is of a size for being slept on by at least one person, the outer portion extends at least partially around the inner portion, the inner portion is made of a foam material, the outer portion is made of a foam material, the inner portion has a plurality of apertures, the apertures are of a constant diameter, the apertures are spaced apart by a constant distance, and the apertures cause the inner portion to have a lower compression rate than the outer portion whereby the weight of the person on the inner portion is distributed over a greater area than would be the case if the inner portion had the same compression rate as the outer portion, and whereby the outer portion constrains the inner portion and controls lateral deformation of the inner portion caused by the weight of the person on the inner portion.

2. A mattress according to claim 1 in which the inner portion is in the shape of a sleeping person.

3. A mattress according to claim 2 in which the shape is the shape of a sleeping person in one sleeping position.

4. A mattress according to claim 2 in which the shape is in the shape of a sleeping person in more than one sleeping position.

5. A mattress according to claim 1 which the outer portion extends all around the inner portion except for a foot part of the inner portion.

6. A mattress according to claim 1 and including a top covering layer, the top covering layer being such that it extends over the inner and outer portions.

7. A mattress according to claim 1 in which the top covering layer is made of a foam material.

8. A mattress according to claim 1 in which the inner portion is all in one piece.

* * * * *